US011248566B2

(12) United States Patent
Choi et al.

(10) Patent No.: US 11,248,566 B2
(45) Date of Patent: Feb. 15, 2022

(54) EXHAUST GAS RECIRCULATION COOLER

(71) Applicants: Hyundai Motor Company, Seoul (KR); Kia Motors Corporation, Seoul (KR)

(72) Inventors: Jae Seok Choi, Gyeonggi-do (KR); Ki Seok Lee, Gyeonggi-do (KR); Yong Hoon Kim, Seoul (KR); Yang Geol Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/672,726

(22) Filed: Nov. 4, 2019

(65) Prior Publication Data

US 2020/0386196 A1 Dec. 10, 2020

(30) Foreign Application Priority Data

Jun. 5, 2019 (KR) ..... 10-2019-0066920

(51) Int. Cl.

| | |
|---|---|
| ***F02M 26/30*** | (2016.01) |
| ***F01P 11/04*** | (2006.01) |
| ***F02M 26/22*** | (2016.01) |
| *F02M 26/28* | (2016.01) |
| *F02M 26/29* | (2016.01) |

(52) U.S. Cl.

CPC ..... *F02M 26/30* (2016.02); *F01P 11/04* (2013.01); *F02M 26/22* (2016.02); *F02M 26/28* (2016.02); *F02M 26/29* (2016.02)

(58) Field of Classification Search

CPC .... F01P 2003/021; F01P 3/02; F01P 2060/02; F02M 26/24; F02M 26/28; F02M 26/30; F02M 26/22; F02M 26/23; F02M 26/29; F02M 26/32; Y02T 10/16

See application file for complete search history.

(56) References Cited

U.S. PATENT DOCUMENTS

| | | | | |
|---|---|---|---|---|
| 6,360,702 | B1 * | 3/2002 | Osada | F28D 7/0066 123/196 AB |
| 2003/0140629 | A1 * | 7/2003 | Shirakawa | F02D 41/0052 60/600 |
| 2016/0186704 | A1 * | 6/2016 | Murotani | F02M 26/28 123/568.12 |
| 2017/0107952 | A1 * | 4/2017 | Yang | F02M 26/32 |
| 2017/0138320 | A1 * | 5/2017 | Kim | F02M 26/30 |
| 2017/0370329 | A1 * | 12/2017 | Chun | F28F 1/02 |

* cited by examiner

*Primary Examiner* — Hai H Huynh
*Assistant Examiner* — Diem T Tran
(74) *Attorney, Agent, or Firm* — Mintz Levin Cohn Ferris Glovsky and Popeo, P.C.; Peter F. Corless

(57) ABSTRACT

An exhaust gas recirculation (EGR) cooler is provided and includes a plurality of tubes that are spaced apart from each other and a cavity that is disposed on an engine to receive the plurality of tubes. A coolant guide guides a coolant to the plurality of tubes and a cover then closes the cavity. The cavity has an inlet port that communicates with a water jacket of the engine and the cavity receives the coolant from the water jacket of the engine through the inlet port.

9 Claims, 6 Drawing Sheets

EXHAUST GAS RECIRCULATION COOLER

CROSS-REFERENCE TO RELATED APPLICATION

This application is based on and claims the benefit of priority to Korean Patent Application No. 10-2019-0066920, filed on Jun. 5, 2019, the disclosure of which is incorporated herein in its entirety by reference.

TECHNICAL FIELD

The present disclosure relates to an exhaust gas recirculation (EGR) cooler inserted into an engine, and more particularly, to an EGR cooler allowing a coolant to be guided more evenly to tubes within the EGR cooler to more evenly distribute the coolant to the tubes, thereby improving the cooling performance of the EGR cooler.

BACKGROUND

Various technologies have been developed to reduce exhaust gases such as nitrogen oxides ($NO_x$) in accordance with vehicle emission regulations, and one of them is an exhaust gas recirculation (EGR) system that recirculates a portion of the exhaust gases back into an intake part to reduce the emission of $NO_x$ and the like contained in the exhaust gases.

Recently, a cooled EGR system has been widely used to improve the combustion of gasoline engines and the like (e.g., reduction of knocking), thereby improving fuel efficiency (by approximately 1.5%-2.0%). In the cooled EGR system, the EGR gas is recirculated from an exhaust system of the engine to an intake system of the engine, which decreases an oxygen concentration in an air/fuel mixture, thus suppressing self-ignition under the same ignition conditions and optimizing the ignition timing, thereby improving fuel efficiency. Meanwhile, in low-load operating conditions, the fuel efficiency may be improved by reducing pumping loss.

As for material cost, the cooled EGR system has excessively occupied approximately 34% of the total system material cost. To expand the applications of the cooled EGR system, it is necessary to reduce the material cost. A technique of inserting an EGR cooler into a cylinder block or a cylinder head of the engine is being developed. The cylinder block or the cylinder head of the engine has a space for receiving the EGR cooler, and the space communicates with a water jacket of the engine. The EGR cooler has a plurality of tubes through which the EGR gas passes, and the tubes are spaced apart from each other to define a gap between adjacent tubes.

As a coolant flows from the water jacket of the engine to the EGR cooler receiving space, the coolant flows through the gap between adjacent tubes and thus, the coolant cools the EGR gas flowing through the tubes. However, the coolant may not be distributed evenly in the EGR cooler. For example, the coolant may only flow around the tubes disposed at the periphery of the EGR cooler, but may flow insufficiently around the tubes disposed at the center of the EGR cooler, and thus the cooling efficiency of the EGR cooler may be reduced. In particular, boiling in the tubes of the EGR cooler may occur, causing a risk of failure of the EGR cooler.

The above information described in this background section is provided to assist in understanding the background of the inventive concept, and may include any technical concept which is not considered as the prior art that is already known to those skilled in the art.

SUMMARY

The present disclosure provides an exhaust gas recirculation (EGR) cooler allowing a coolant to be guided more evenly to tubes within the EGR cooler to evenly distribute the coolant to the tubes, thereby improving the cooling performance of the EGR cooler. According to an aspect of the present disclosure, an EGR cooler may include: a plurality of tubes spaced apart from each other; a space provided on an engine to receive the plurality of tubes; a coolant guide that guides a coolant to the plurality of tubes; and a cover closing the space.

The space may have an inlet port that communicates with a water jacket of the engine, and the space may receive the coolant from the water jacket of the engine through the inlet port. The coolant guide may guide the coolant from the inlet port of the space to the plurality of tubes. In particular, the coolant guide may be a tapered tunnel that covers from a portion of the space adjacent to the inlet port to the middle of the tubes. The coolant guide may also include a central guide wall, and a pair of side guide walls connected to sides of the central guide wall, respectively.

The central guide wall may have a first end portion tightly contacting (e.g., abutting) an inner surface of the space, and a second end portion directly attached to the middle of an outermost tube. The central guide wall may be tapered from the first end portion to the second end portion. The side guide wall may have a first end portion tightly contacting (e.g., abutting) an inner surface of the space, and a second end portion directly attached to the middle of side surfaces of the tubes. The side guide wall may be tapered from the first end portion to the second end portion. The space may be divided by the coolant guide into a first space adjacent to the inlet port of the space and a second space far away from the inlet port of the space. The coolant guide may have an opening that communicates with the inlet port of the space, and the opening may have the same shape as that of the inlet port of the space. The cover may have an outlet port discharging the coolant.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
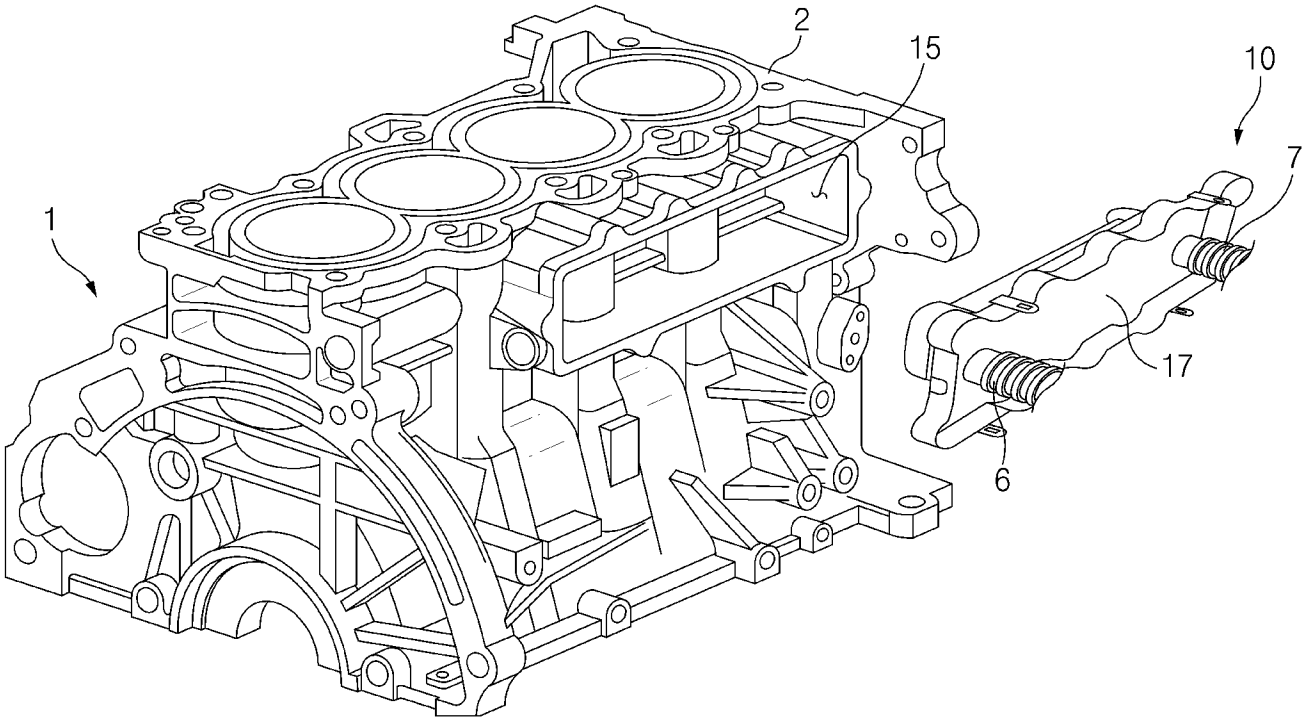
FIG. 1 illustrates an exploded perspective view of a state in which an exhaust gas recirculation (EGR) cooler according to an exemplary embodiment of the present disclosure is separated from a receiving space of a cylinder block of an engine.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, exemplary embodiments of the present disclosure will be described in detail with reference to the accompanying drawings. In the drawings, the same reference numerals will be used throughout to designate the same or equivalent elements. In addition, a detailed description of well-known techniques associated with the present disclosure will be ruled out in order not to unnecessarily obscure the gist of the present disclosure.

Terms such as first, second, A, B, (a), and (b) may be used to describe the elements in exemplary embodiments of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

Figure 2:
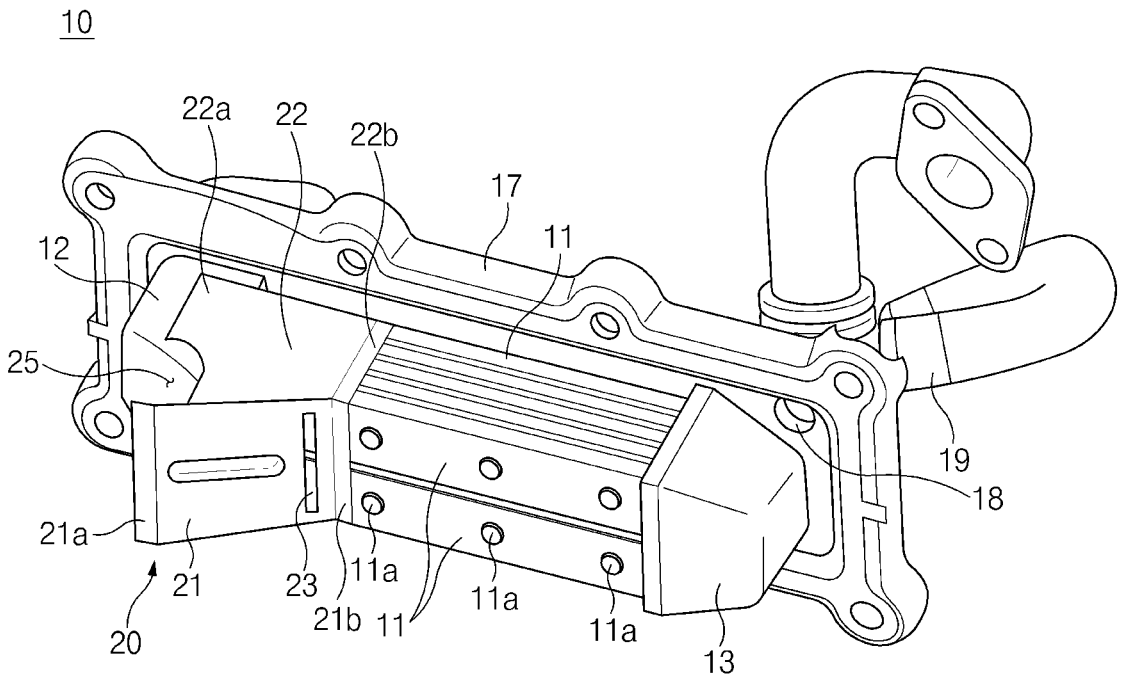
FIG. 2 illustrates a perspective view of an EGR cooler according to an exemplary embodiment of the present disclosure.

Referring to FIGS. 1 and 2, an exhaust gas recirculation (EGR) cooler 10 according to an exemplary embodiment of the present disclosure may include a plurality of tubes 11 spaced apart from each other, a receiving space 15 (e.g., a cavity) provided on an engine 1 to receive the plurality of tubes 11, and a coolant guide 20 that guides a coolant to the plurality of tubes 11.

Figure 4:
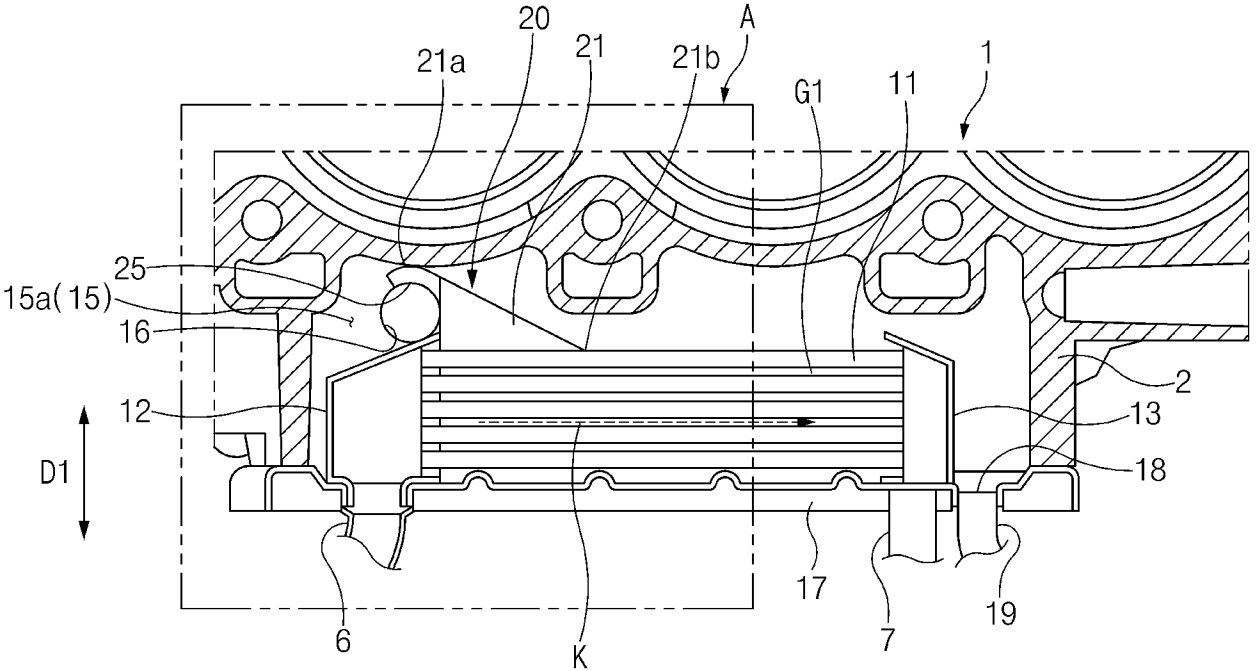
FIG. 4 illustrates a cross-sectional view of an EGR cooler according to an exemplary embodiment of the present disclosure.

Referring to FIG. 4, an EGR gas may flow in each tube 11, and the plurality of tubes 11 may be arranged in parallel to each other between a pair of headers 12 and 13. Both ends of each tube 11 may be connected to the pair of headers 12 and 13 to communicate therewith, respectively. Since the tubes 11 are spaced apart from each other, gaps G1 and G2 may be defined between the adjacent tubes 11, and the coolant may flow through the gaps G1 and G2 between the tubes 11. For example, the plurality of tubes 11 may be spaced apart from each other in a first direction (see direction D1 in FIG. 4) and thus, a first gap G1 may be defined between the tubes 11 adjacent in the first direction, and the plurality of tubes 11 may be spaced apart from each other in a second direction (see direction D2 in FIG. 6) and thus, a second gap G2 may be defined between the tubes 11 adjacent in the second direction. In particular, the first direction D1 may be a direction in which the tubes 11 are stacked, and the second direction D2 may be a direction corresponding to a width direction of each tube 11.

Each tube 11 may have a plurality of protrusions 11*a* formed on top and bottom surfaces thereof. The protrusions 11*a* of each tube 11 may be joined to the protrusions 11*a* of another adjacent tube 11 by welding and thus, the adjacent tubes 11 stacked in the first direction may be spaced apart from each other by the first gap G1. The space or cavity 15 may be provided on the engine 1, and the space 15 may be open to the outside of the engine 1. Since the plurality of tubes 11 and the pair of headers 12 and 13 are received in the space 15, the EGR cooler 10 may be integrally combined with the engine 1. The space 15 may have an inlet port 16 that communicates with a water jacket 3 of the engine 1, and the coolant may flow from the water jacket 3 of the engine 1 to the space 15 through the inlet port 16.

According to an exemplary embodiment, the space 15 may be defined in a cylinder block 2 of the engine 1 as illustrated in FIG. 1. The plurality of tubes 11 and the pair of headers 12 and 13 may be inserted into the cylinder block 2 of the engine 1 and thus, the EGR cooler 10 may be integrally combined with the cylinder block 2 of the engine 1. The space or cavity 15 may communicate with the water jacket 3 of the cylinder block 2 through the inlet port 16, and the coolant may flow from the water jacket 3 of the cylinder block 2 to the space 15 through the inlet port 16.

According to another exemplary embodiment, the space or cavity 15 may be formed in a cylinder head (not shown) of the engine 1. The plurality of tubes 11 and the pair of headers 12 and 13 may be inserted into the cylinder head of the engine 1 and thus, the EGR cooler 10 may be integrally combined with the cylinder head of the engine 1. The EGR cooler 10 according to an exemplary embodiment of the present disclosure may include a cover 17 that closes an opening of the space 15 in a sealing manner, and the space 15 may be sealed in the engine 1 by the cover 17.

The cover 17 may have an outlet port 18 through which the coolant may be discharged, and a coolant discharge pipe 19 may be sealingly connected to the outlet port 18 (e.g., a sealed connection). The pair of headers 12 and 13 may be sealingly coupled to an inner surface of the cover 17 (e.g., a sealed connection), and an EGR gas intake pipe 6 and an EGR gas exhaust pipe 7 may be connected to the headers 12 and 13, respectively. The EGR gas intake pipe 6 may pass through the cover 17 and be sealingly connected to the header 12 to communicate with the header 12, and thus, the EGR gas intake pipe 6 may allow the EGR gas to flow into each tube 11. The EGR gas exhaust pipe 7 may pass through the cover 17 and be sealingly connected to the header 13 to communicate with the header 13, and thus, the EGR gas exhaust pipe 7 may allow the EGR gas to be discharged from each tube 11.

Figure 5:
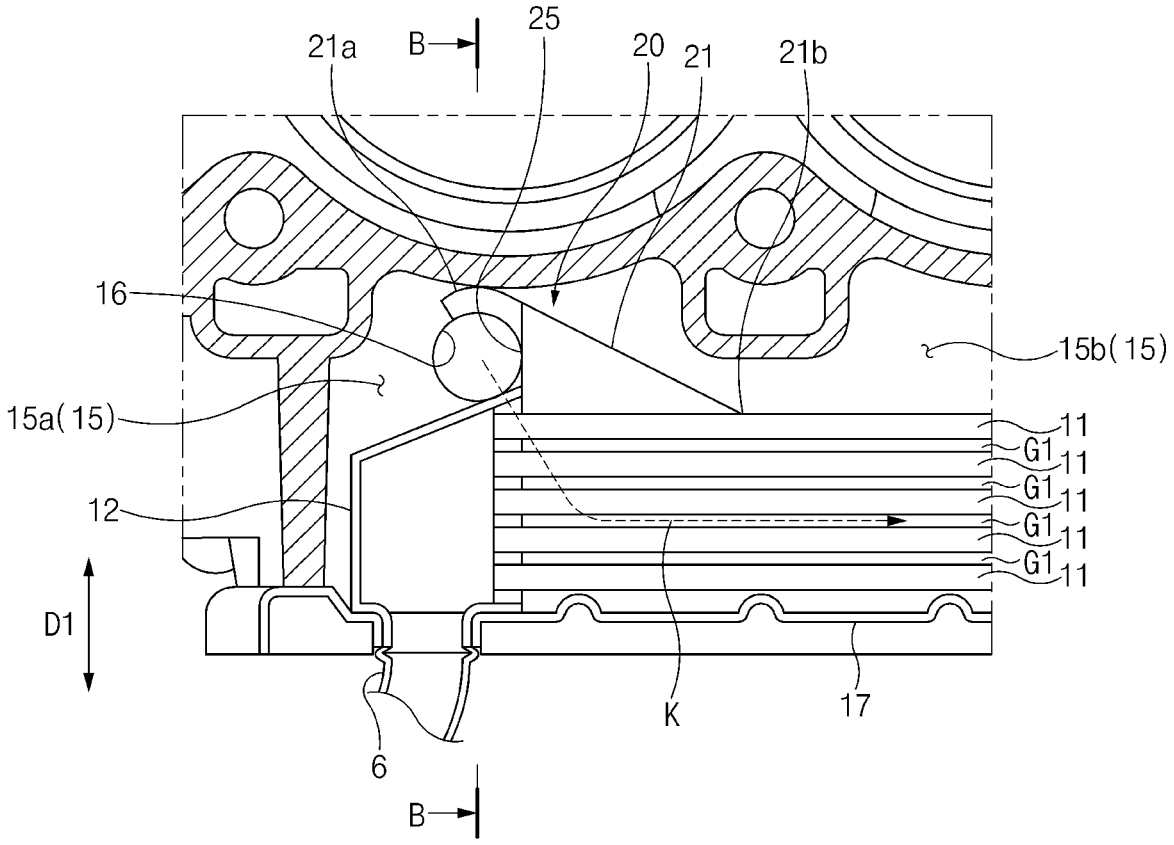
FIG. 5 illustrates an enlarged view of portion A of FIG. 4 according to an exemplary embodiment of the present disclosure.
Figure 6:
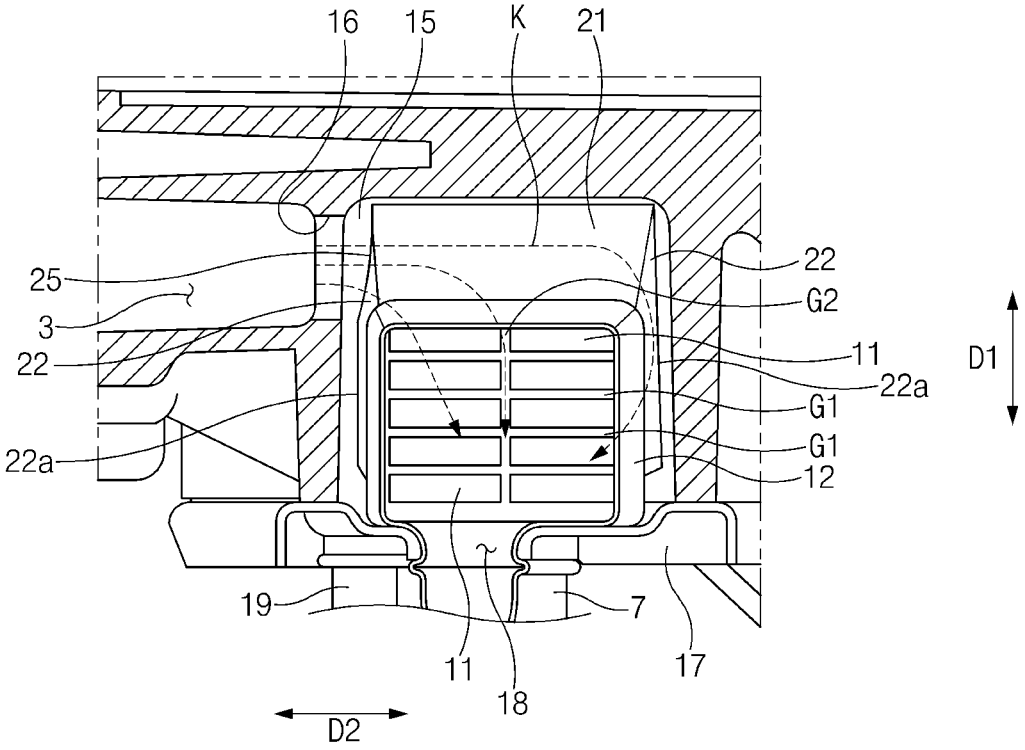
FIG. 6 illustrates a cross-sectional view taken along line B-B of FIG. 5 according to an exemplary embodiment of the present disclosure.

Referring to FIGS. 2 to 6, the coolant guide 20 may guide the coolant from the inlet port 16 of the space 15 to the gaps G1 and G2 between the plurality of tubes 11. When the coolant flows from the water jacket 3 of the engine 1 to the space 15 through the inlet port 16 of the space 15, the coolant may be guided to the gaps G1 and G2 between the tubes 11 by the coolant guide 20 as illustrated in FIGS. 5 and 6 (see a direction indicated by arrow K in FIGS. 5 and 6).

Figure 3:
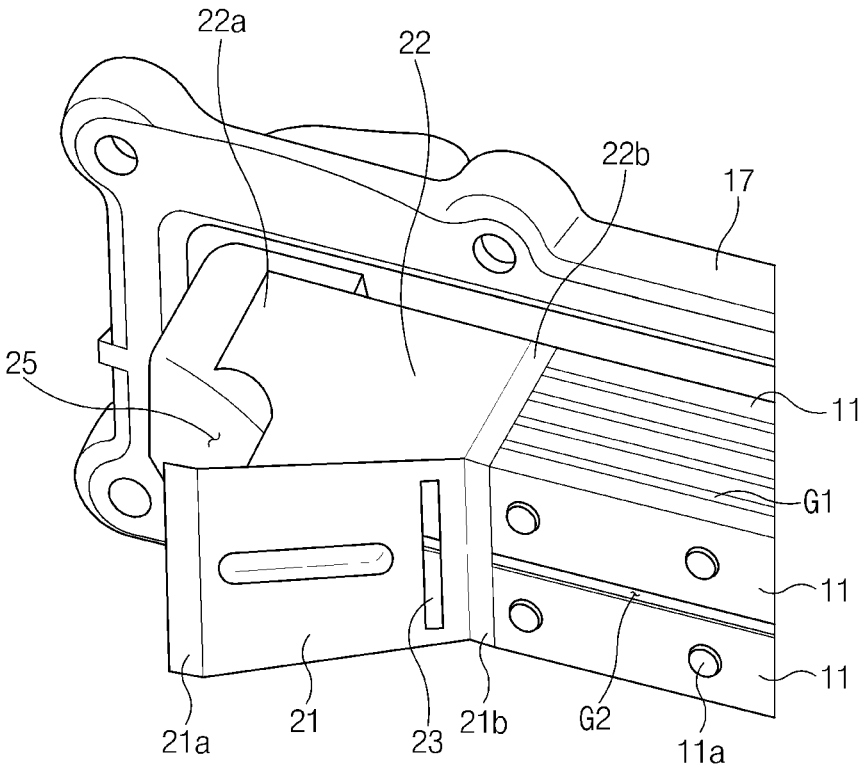
FIG. 3 illustrates an enlarged view of a coolant guide of FIG. 2 according to an exemplary embodiment of the present disclosure.

Referring to FIGS. 2, 3, and 6, the coolant guide 20 may be a tapered tunnel that covers from a portion of the space or cavity 15 adjacent to the inlet port 16 to the middle of the tubes 11 (e.g., an approximate middle of a longitudinal length of the tubes). The coolant guide 20 may include a central guide wall 21, and a pair of side guide walls 22 connected to sides of the central guide wall 21, respectively. The central guide wall 21 may have a first end portion 21*a* tightly contacting or abutting an inner surface of the space 15, and a second end portion 21*b* directly attached to the middle of an outermost tube 11. The central guide wall 21 may be tapered from the first end portion 21*a* to the second end portion 21*b*. Each side guide wall 22 may have a first end portion 22*a* tightly contacting or abutting the inner surface of the space 15, and a second end portion 22*b* directly attached to the middle of side surfaces of the tubes 11. The side guide wall 22 may be tapered from the first end portion 22*a* to the second end portion 22*b*.

Referring to FIG. 5, since the first end portion 21*a* of the central guide wall 21 and the first end portion 22*a* of the side guide wall 22 abut the inner surface of the space 15, and the second end portion 21*b* of the central guide wall 21 and the second end portion 22*b* of the side guide wall 22 are directly attached to the tubes 11, the space 15 may be divided by the coolant guide 20 into a first space 15*a* adjacent to the inlet port 16 of the space 15 and a second space 15*b* distant from the inlet port 16 of the space 15.

In addition, the central guide wall 21 may include at least one communication aperture 23 providing communication between the first space 15*a* and the second space 15*b*. The coolant guide 20 may include an opening 25 in direct communication with the inlet port 16 of the space 15. The opening 25 may be formed in a portion of the coolant guide 20 facing the inlet port 16 of the space 15 in which the side guide walls 22 and the central guide wall 21 are connected. In particular, the opening 25 may have the same shape as that of the inlet port 16 of the space 15. For example, when the inlet port 16 of the space 15 is circular, the opening 25 may have the same-sized circular shape.

According to the above-described exemplary embodiments of the present disclosure, in a structure in which the plurality of tubes 11 and the pair of headers 12 and 13 are received in the space 15 of the engine 1 communicating with the water jacket 3 of the engine 1, the coolant may be guided by the coolant guide 20 to be distributed more evenly from the water jacket 3 of the engine 1 to the gaps G1 and G2 between the tubes 11, and thus, the cooling performance of the EGR cooler may be improved.

As set forth above, the EGR cooler according to exemplary embodiments of the present disclosure may have the structure in which the plurality of tubes and the pair of headers are received in the space of the engine communicating with the water jacket of the engine, allowing the coolant to be guided by the coolant guide to be distributed more evenly from the water jacket of the engine to the gaps between the tubes, thereby improving the cooling performance thereof.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. An exhaust gas recirculation (EGR) cooler, comprising:
- a plurality of tubes spaced apart from each other;
- a cavity provided on a cylinder block of an engine to receive the plurality of tubes;
- a coolant guide that is received within the cavity to guide a coolant to the plurality of tubes; and
- a cover that closes the cavity,
- wherein the cavity includes an inlet port that communicates directly with a water jacket of the cylinder block,
- wherein the coolant guide includes a tapered tunnel that covers from a portion of the cavity adjacent to the inlet port to a middle section of the tubes,
- wherein the coolant guide includes a central guide wall, and a pair of side guide walls connected to sides of the central guide wall, respecrively,
- wherein the cavity is divided by the coolant guide into a first cavity adjacent to the inlet port of the cavity and a second cavity distant from the inlet port of the cavity, and
- wherein the central guide wall includes at east one communication aperture providing communication between the first cavity and the second cavity.

2. The EGR cooler according to claim 1, wherein the coolant guide guides the coolant from the inlet port of the cavity to the plurality of tubes.

3. The EGR cooler according to claim 1, wherein the central guide wall has a first end portion abutting an inner surface of the cavity, and a second end portion directly attached to the middle of an outermost tube.

4. The EGR cooler according to claim 3, wherein the central guide wall is tapered from the first end portion to the second end portion.

5. The EGR cooler according to claim 1, wherein the side guide wall has a first end portion abutting an inner surface of the cavity, and a second end portion directly attached to side surfaces of the tubes.

6. The EGR cooler according to claim 5, wherein the side guide wall is tapered from the first end portion to the second end portion.

7. The EGR cooler according to claim 1, wherein the coolant guide includes an opening in communication with the inlet port of the cavity, and the opening has the same shape as a shape of the inlet port of the cavity.

8. The EGR cooler according to claim 1, wherein the cover has an outlet port through which the coolant is discharged.

9. The EGR cooler of claim 1, wherein the EGR cooler is mounted within a vehicle.

* * * * *